United States Patent [19]

Frassati et al.

[11] Patent Number: 4,758,935

[45] Date of Patent: Jul. 19, 1988

[54] AMBIENT ILLUMINATION SYSTEM

[75] Inventors: Guido Frassati, Leumann; Giuseppe Muglialdo, Pino Torinese; Riccardo Valvassori, Turin, all of Italy

[73] Assignee: S.A.M.E.S. S.p.A., Pinerolo, Italy

[21] Appl. No.: 883,956

[22] Filed: Jul. 10, 1986

[30] Foreign Application Priority Data

Jul. 24, 1985 [IT] Italy ..... 67680 A/85

[51] Int. Cl.[4] ..... F21S 3/14

[52] U.S. Cl. ..... 362/147; 362/285; 362/430

[58] Field of Search ..... 362/145, 147, 153, 249, 362/250, 285, 348, 367, 404, 410, 411, 430, 801; 206/371; 52/28.39

[56] References Cited

U.S. PATENT DOCUMENTS

| | | | |
|---|---|---|---|
| 1,938,237 | 12/1933 | Wagenhurst | 362/147 |
| 2,858,381 | 10/1958 | Goldberg et al. | 362/407 |
| 3,051,772 | 8/1962 | Davis | 362/150 |
| 3,660,820 | 5/1972 | Liberman | 362/150 |
| 3,748,463 | 7/1973 | Trassinelli | 362/411 |
| 4,085,317 | 4/1978 | Mithoff | 362/430 |
| 4,414,617 | 11/1983 | Galindo | 362/285 |
| 4,430,694 | 2/1984 | Koivumaki | 362/285 |
| 4,566,058 | 1/1986 | Barnett | 362/430 |
| 4,646,211 | 2/1987 | Gallant et al. | 362/801 |

*Primary Examiner*—Ira S. Lazarus
*Assistant Examiner*—D. M. Cox
*Attorney, Agent, or Firm*—Shlesinger, Arkwright & Garvey

[57] ABSTRACT

The illumination system of this invention includes a support structure that retains electrical supply cables and holds at least one plug socket which is connected to the supported cables. The support structure further carries at least one slidable lamp assembly that is supplied via the plug sockets. The support structure is self-supporting and may be coupled to the ceiling by carriers.

20 Claims, 5 Drawing Sheets

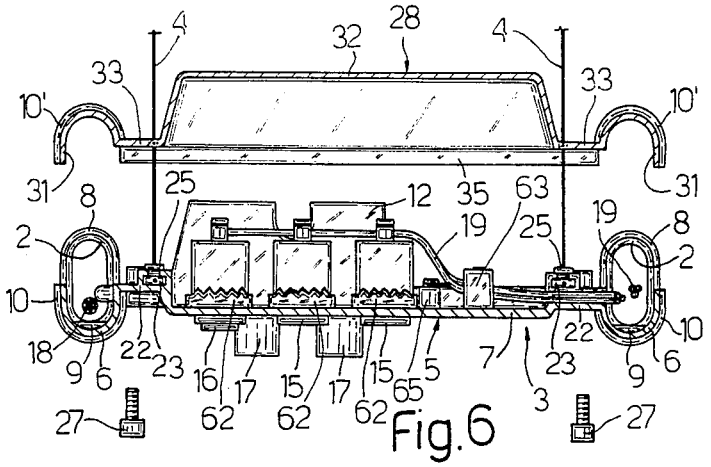
Fig.6
Fig.4
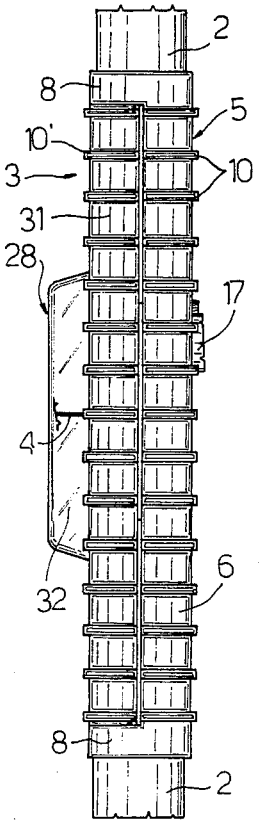
Fig.5
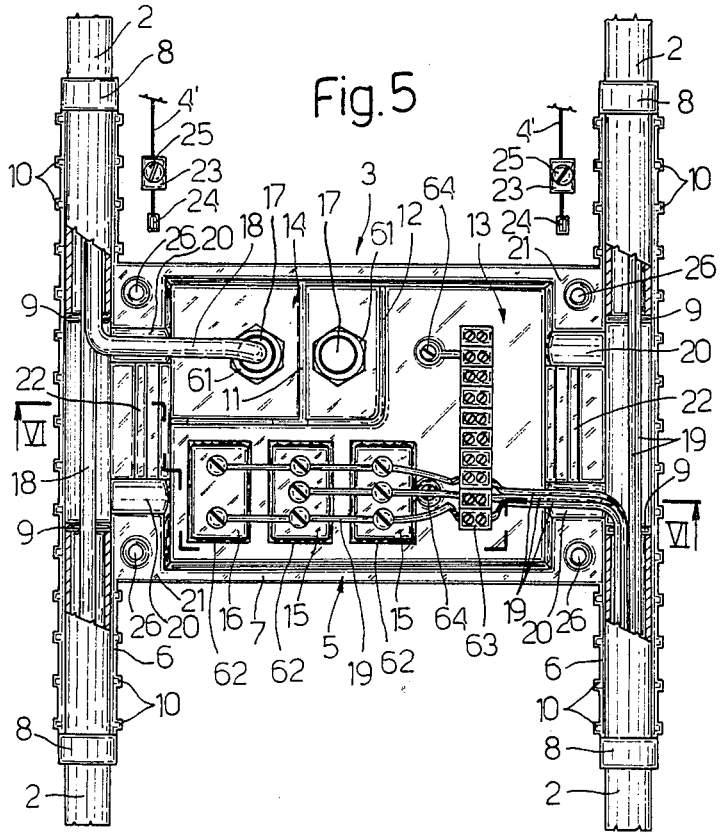

49
44'
38'
50
39
48
10"
40
47'
2
41
37
52
53
38"

AMBIENT ILLUMINATION SYSTEM

BACKGROUND OF THE INVENTION

The present invention relates to an ambient illumination system of the type having a modular supporting structure which can be conveniently fitted to the ceiling for supporting electrical sources of illumination.

The ambient illumination systems of this type which are known have a supporting structure which is configured (generally by means of modular elements) in dependence on the various zones of illumination which it is desired to obtain, so that the electrical illumination sources are incorporated in determined positions of the structure. The principle disadvantage which is experienced in illumination systems of this type relates to the fact that if it is desired to modify the zones of ambient illumination, for example for a different arrangement of working surfaces, it is necessary to dismantle the supporting structure, at least partially, to provide a different configuration of the electrical illumination sources which are incorporated. This operation of dismantling and subsequent reassembly into a different configuration is particularly disadvantageous in cases in which other service cables, as well as the electrical supply cables, are housed in the supporting structure, such as telephone cables, supply cables for loudspeakers, television cameras etc.

Moreover, if sources of illumination of different type or power, and therefore of different dimensions from those already incorporated in the structure become necessary, this often gives rise to great problems of modular adaptation which require the dismantling and different configuration of the structure with all the disadvantages indicated above.

SUMMARY OF THE INVENTION

The object of the present invention is that of providing an ambient illumination system which overcomes the disadvantages indicated above and therefore allows the zones of illumination to be modified and also the type of electrical illumination source to be changed in a very simple and rapid manner.

Other objects and advantages obtained with the illumination system of the present invention will become apparent from the following description.

According to the present invention there is therefore provided an ambient illumination system characterised by the fact that it comprises first means constituting a fixed supporting structure able to house at least electrical supply cables, means supported in the fixed position by the first means and comprising at least an electrical connector connected to the cables, and third means supported by the first means and displaceable along them and including electrical sources of illumination supplied by the connectors of the second means.

BRIEF DESCRIPTION OF THE DRAWINGS

For a better understanding of the present invention various embodiments are now described, purely by way of non-limitative example, with reference to the attached drawings, in which:

FIG. 4 is a side elevational view of the unit of FIG. 3;

FIG. 5 is a top plan view with portions broken away of the unit of FIG. 3;

FIG. 6 is an assembly drawing of the unit of FIG. 5 taken along the line VI—VI;

DETAILED DESCRIPTION OF THE INVENTION

Figure 1:
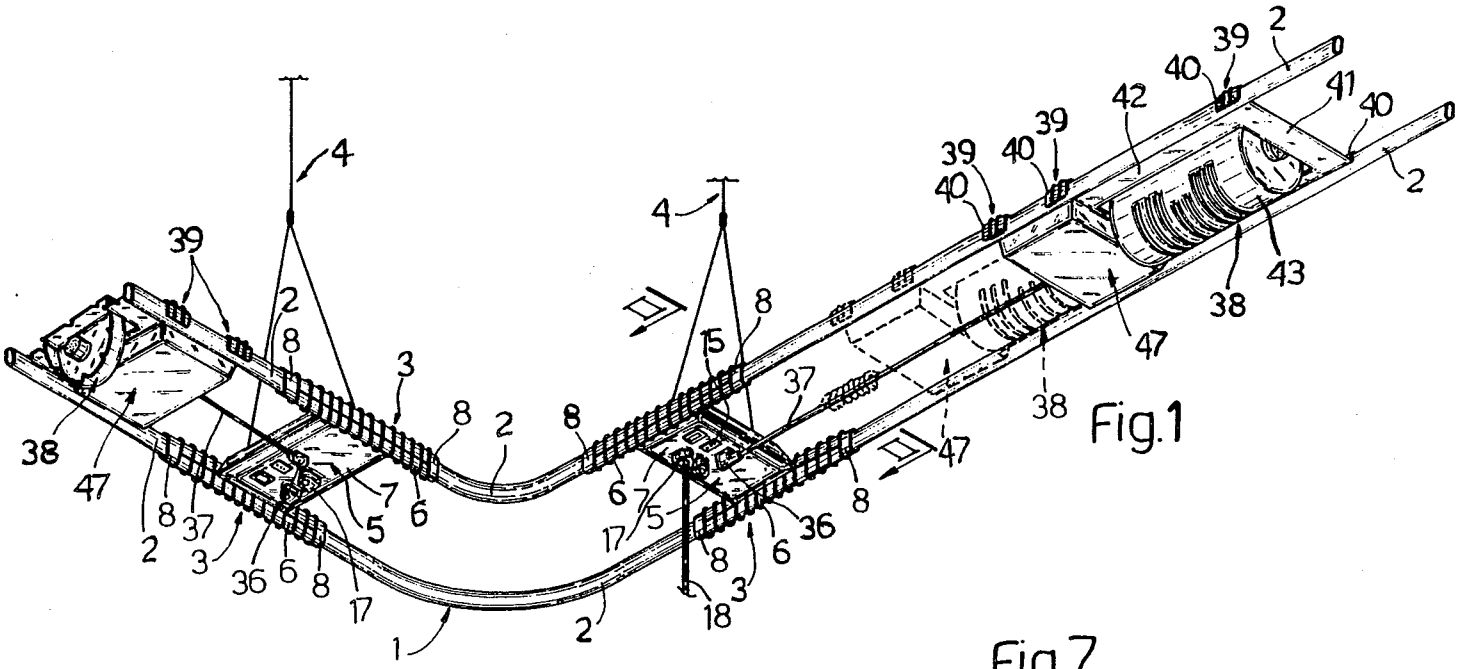
FIG. 1 is a perspective view from below of a portion of a first embodiment of the ambient illumination system according to the principles of the present invention.

With reference to FIG. 1, the ambient illumination system of the present invention comprises a supporting structure 1 which is formed from a plurality of pairs of tubular elements 2 which are interconnected by units 3 which will be described in more detail below. Such tubular elements 2 are disposed spaced, parallel and substantially in the same plane of horizontal symmetry so as to define a rigid structure which is conveniently fixed to the ceiling, for example by means of suspension wires 4 which are connected to the interconnection units 3 in a manner which will be described in more detail below. In particular, the tubular hollow elements 2 are oval in section, with the major dimension perpendicular to the common plane in which they lie, so as to increase the rigidity of the structure 1 itself to deformations perpendicular to the common plane.

The interconnection units 3, better seen in FIGS. 2 to 6, have a main lower part 5 which has two parallel spaced portions 6 of channel form, the dimensions of which are such that they can receive the tubular elements 2, and are joined by an intermediate plate 7. Each channel portion 6 has at its respective ends a closed annular edge 8 which forms a fixed introduction aperture for the tubular elements; further, within the channel portions 6 there are formed two projections 9 which serve as end stops for the tubular elements 2 inserted therein. On the exterior of the channel portion 6 there are formed spaced parallel ribs 10. The intermediate plate portion 7, integral with the lateral channel portions 6, has a substantially rectangular form and an inner cavity which is separated by a screen 12 so as to form two zones 13 and 14 respectively. In the zone 13 there are formed apertures for housing electrical connectors 15 and, conveniently, signalling elements or switches 16.

In the zone 14 there are formed apertures in which are disposed fixing bushings 17 for service wires 18, for example telephone lines. Such bushes 17 are fixed to the plates 7 by nuts 61 which fixed to the inner surface, and are separated from one another with a further screen 11.

To the electrical connectors 15 and to the elements 16 there are connected electrical wires 19 which lead from a terminal block 63 which is secured by small brackets locked by screws 64 on respective columns 65 of the plate 7. Such wires 19, like the service cables 18, are connected to the other side of the terminal block 63 and pass into cavities 20 formed in lateral zones 21 of the intermediate plate towards the channel portions 6 and the tubular elements 2 through the interior of which they pass. The electrical connectors 15 and the elements 16 can be conveniently fixed in the zones 13 in any convenient manner, for example with leaf spring clips 62 and knurled smaller inner sides, with the possibility of interchangeability for adaptation to different regulations. Between the two cavities 20 of each lateral zone 21 there is formed an undercut cavity 22 with an upper slot in which 23 (FIGS. 5 and 6) is slidably housable, in the interior of which body passes a respective end 4' of the suspension wire 4, having a terminal weight 24, whilst onto the body 23 can be screwed a screw 25, the shank of which passes into the slot of the cavity 22 for fixing the body 23 into the cavity 22 itself.

Towards the ends of the two lateral zones 21 of the plate 7 there are formed respective holes 26 into which pass screws 27 which fix an upper cover 28 which, as is visible in FIG. 6, has two spaced parallel channel portions 31 able to engage the channel portions 6 of the main lower part 5 and also having spaced parallel outer ribs 10'. The portions 31 are connected by an intermediate portion 32 covering the intermediate plate 7 of the lower part 5, and having a central main part forming an inner cavity, and two lateral zones 33 which rest on the lateral zones 21 of the plate 7 and which have slots 34 (FIG. 3) for the passage of the ends 4' of the suspension wires. This portion 32 further has a pair of facing lower edges 35 which cover the corresponding lateral edges of the intermediate plate 7 perpendicular to the axis of the channel portions 6.

Figure 7:
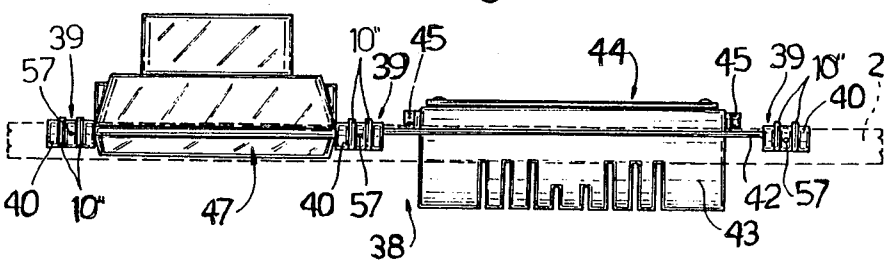
FIGS. 7 and 8 are respectively side and front elevational views of an illumination unit of the system of FIG. 1.
Figure 8:
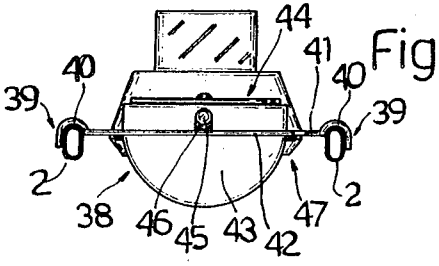
Figure 2:
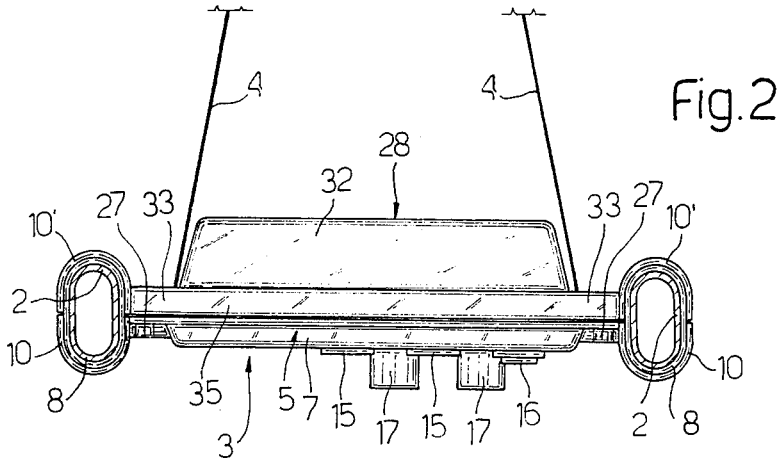
FIG. 2 is a sectional view taken on the line II—II of FIG. 1.
Figure 3:
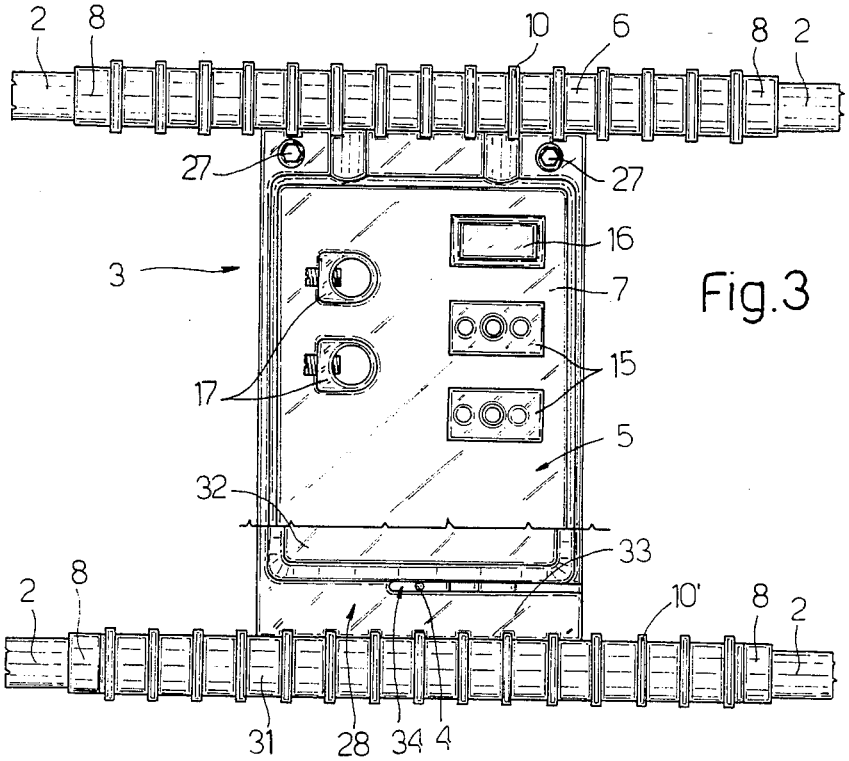
FIG. 3 is a bottom plan view of an interconnection unit of the system of FIG. 1.

As is visible in FIG. 1, to one of the electrical connectors 15 of an interconnection unit 3 there is connected an electrical plug 36 of an electrical cable 37, having conveniently spiral coils (shown in broken outline) supplying an illumination unit 38 which is supported by the tubular elements 2 of the supporting structure 1. As is more clearly illustrated in FIGS. 7 and 8, the illumination unit 38 includes three supporting brackets 39 disposed parallel, spaced and transversely of the longitudinal axis of the supporting structure 1, and each of which has a pair of end portions 40 of channel shape, the concavity of which faces downwardly and with a configuration similar to the channel portions 31 of the upper cover 28, and with parallel spaced outer ribs 10''. These pairs of portions 40 are connected in an integral manner by an intermediate plate 41. Between the intermediate plates 41 of a first pair of support brackets 39 there is fixed a perimetral frame 42 of rectangular form, having an inner aperture also of rectangular form, in which is disposed an outer screen 43 of semi cylindrical form for an electrical source of illumination 44, conveniently a halogen lamp. This outer screen 43 is carried by the perimetal frame 42 by means of two axial pins 45 of the screen 43, which are carried by respective folded projections 46 (FIG. 8) of the frame 42 so as to allow the screen 43 to rotate and, by this, rotation of the source of illumination 44 with respect to the axes of the pins 45. Between the intermediate support bracket 39 to which the perimetral frame 42 is connected and the other, outer support bracket 39, there is fixed an electrical supply unit 47 at which the electrical cable 37 arrives with convenient tensioning means for maintaining it stretched, and with an electrical supply branch for the illumination source 44; this electrical supply unit 47, in the case of supplying a lamp, conveniently includes an inductance, a capacitor, and a starter.

Figures 9, 10, 11:
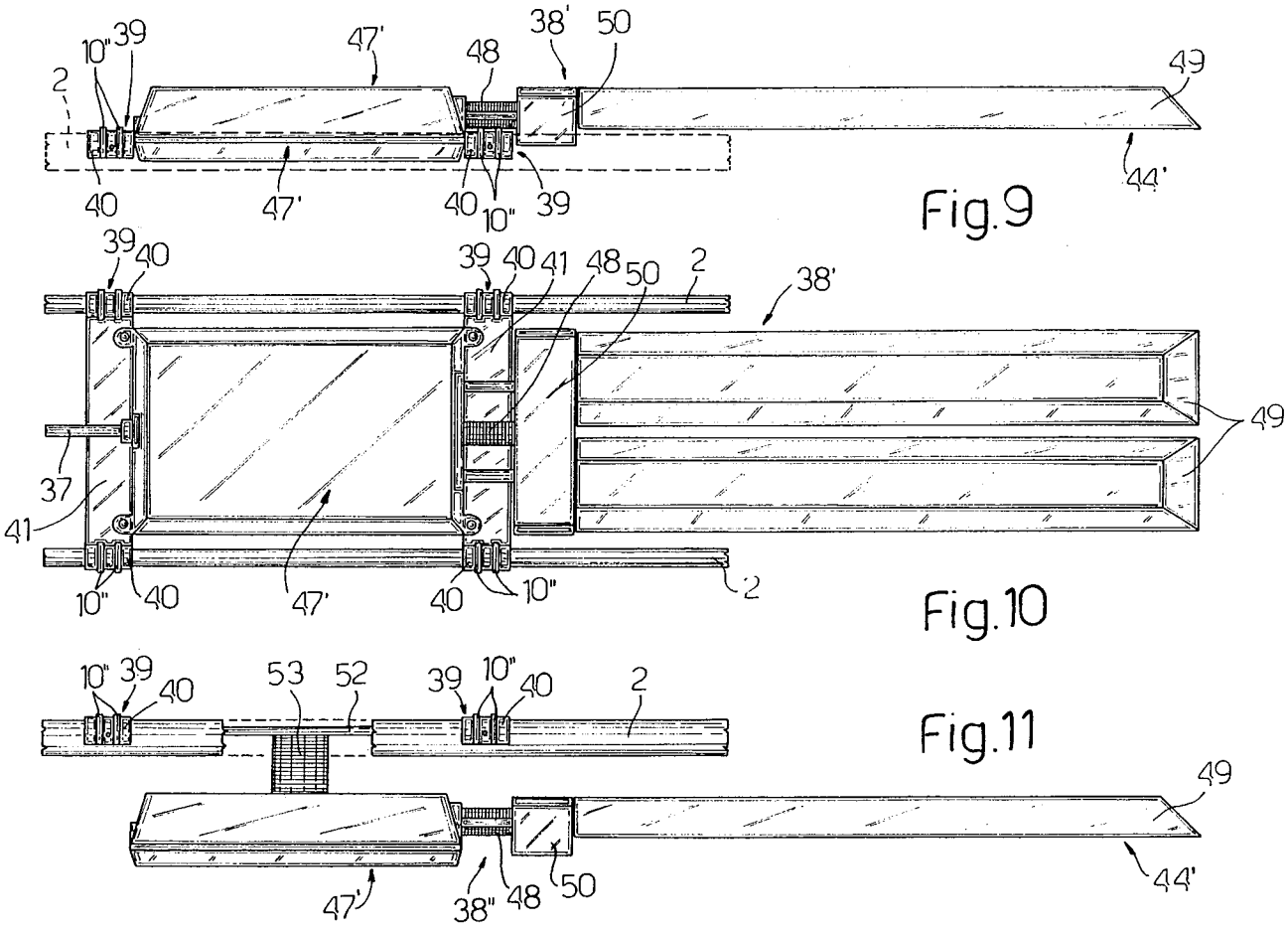
FIGS. 9 and 10, are respectively side elevational and top plan views of a different embodiment of an electrical illumination unit.
FIG. 11 is a side elevational view of a further embodiment of an electrical illumination unit.

In FIGS. 9 and 10 there is illustrated a variant 38' of the electrical illumination unit 38, which includes only a pair of support brackets 39 between which are fixed an electrical supply unit 47', and which carry in a position opposite that at which the electrical cables 37 are received, a small rotation shaft 48 which supports, with the possibility of rotation about its axis, a support element 50 for a pair of upper screens 49 for respective lamps 44' which are supplied by the unit 47.

In FIG. 11 there is illustrated a further variant of the illumination unit of FIG. 10, indicated 38'' and having a frame 52 fixed between the pair of support brackets 39, which supports a lower perpendicular rotation spindle 53 which in turn supports, at its lower end, with the possibility of rotation about the vertical axis of this spindle 53, the electrical supply unit 47' of FIG. 9, which moreover carries the rotation spindle 48 for orientation and support of the pair of screens 49.

Figure 12:
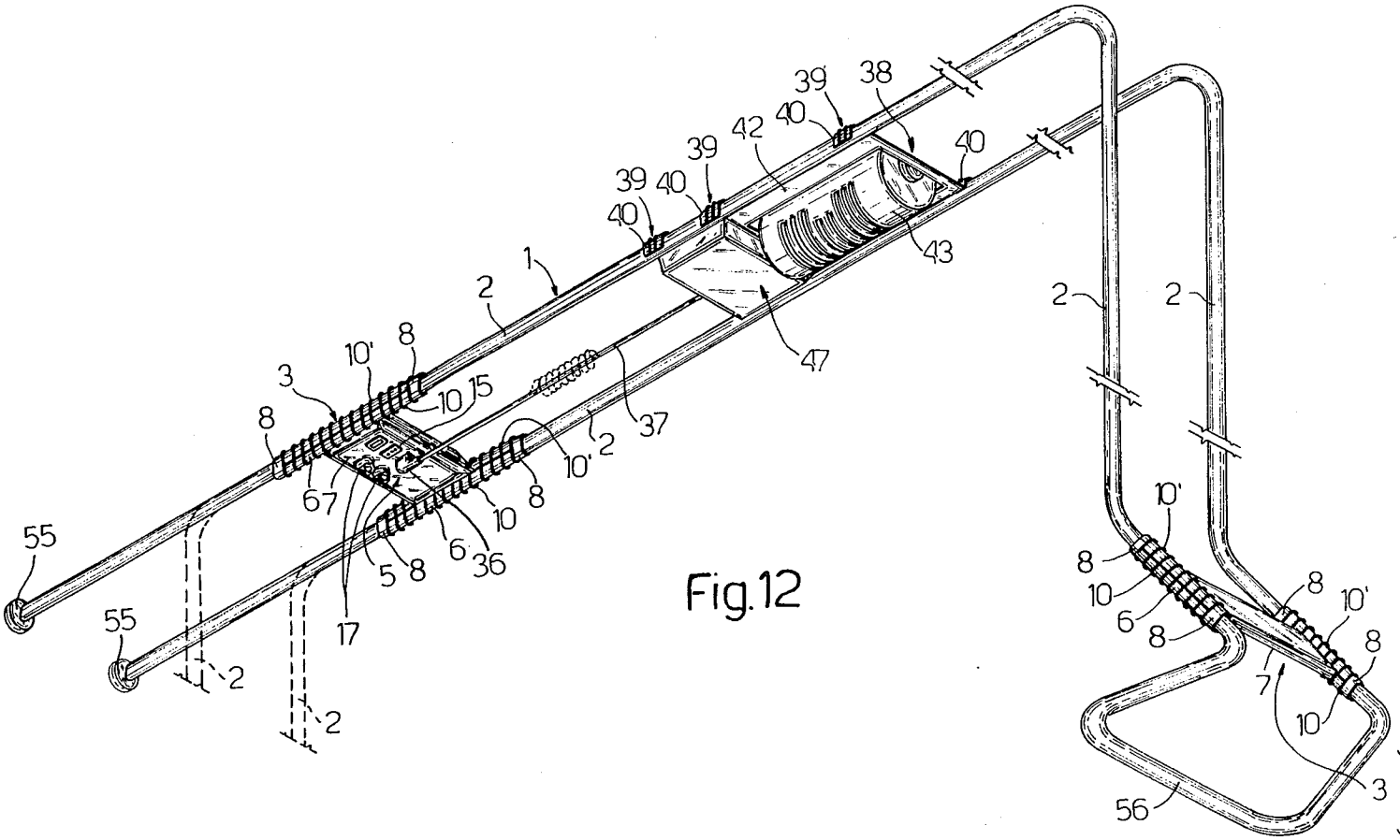
FIG. 12 is a lower perspective view of a different embodiment of the illumination system according to the present invention.

In FIG. 12 there is illustrated a variant of the configuration of the supporting structure 1, which moreover is no longer fixed to the ceiling. End elements 55 of the tubular elements 2 are fixable, for example by means of screws and expansion blocks to a lateral wall of the environment. The other end of the tubular elements 2 are folded downwardly and joined so as to form a floor support 56; in the substantially vertical section of these tubular elements 2 there is also interposed an interconnection unit 3 which can also have only characteristics of mechanical connection between the various elements 2 of the structure 1.

The assembly and operation of the ambient illumination system of the invention described is as follows.

The supporting structure 1 is configured as desired by the user in order to have the various electrical sources of illumination in the positions initially envisaged to obtain greatest functionality, also by choosing suitably shaped sections of the tubular element 2, which are connected together mechanically by means of the interconnection units 3. In particular, the sections of tubular elements 2, after they have been cut into the convenient lengths, are inserted into channel portions 6 of the main lower parts 5 of the interconnection units 3, as illustrated in FIG. 5, and in this first position, stop against the inner projections 9 and are maintained housed by the closed annular edge 8 at the ends of the channel portions 6. Through the tubular elements 2 there are then threaded the various electrical cables 19 and service wires 18 which, in correspondence with the interconnection unit 3, through the cavities 20 for connection, via the connector terminals 36, respectively to the electrical connectors 15 and to the elements 16, and for passage into the zone 14, and finally passing out to the exterior through the bushing 17. In this case, then, the supporting structure 1 must be suspended from the ceiling by means of the support wires 4. The position of the bodies 23 in the cavities 22 are adjusted through screws 25 and therefore the outer length of these wires 4 are adjusted, which wires are then hooked at the top to the ceiling. On the lower part 5 there is then fixed the upper cover 28 by means of the screws 27, so that one also has the locking of the channel portions 31 onto the upper zone of the tubular element 2 lodged in the interconnection units 3. The lateral slots 34 further allow the passage of the suspension wires 4. However, in the case in which the supporting structure 1 does not have to be fixed to the ceiling, after fixing the interconnection unit 3 as described, it is fixed by means of the connection elements 55 to a lateral wall and by means of the support 56. Among other things, as is illustrated in FIG. 12, this supporting structure 1 could be entirely self supporting in that, instead of having elements 55 fixed to a lateral wall, it could have a double end configuration of tubular elements 2 folded downwardly, as is indicated in broken outline so as to provide two floor supports 56.

In the various configurations of the supporting structure 1 described, the user can therefore dispose the illumination units 38 simply by resting these, with the support brackets 39, on the supporting structure 1 in the desired positions and, in particular, the pairs of portions 40 of each bracket 39 rest on the upper surfaces of the tubular elements 2. The simple connection of the electrical plug 36 in the electrical connector 15 of an interconnection unit 3 provides the electrical supply to the illumination units 38. The angular orientation of the illumination source 44 about the axis of the pins 45 (FIGS. 1, 7 and 8) or about the axis of the spindle 48 for the illumination unit 38′ or again, about the two perpendicular axes of the spindles 48 and 53 for the illumination unit 38″ (FIG. 11) allows the illumination conditions to be optimised.

According to the main characteristic of the present invention, if the user wishes to modify, even substantially, the disposition of the various illumination units 38 on the supporting structure 1 it is only necessary simply to displace these units 38 (or 38′ or 38″) into the newly desired position by simply resting the pairs of portions 40 of the support brackets 39 on different zones of the tubular elements 2 (as is illustrated in FIG. 1 in broken outline). If it should be necessary, the illumination unit 38 or 38′ or 38″ can also be orientated differently by means of the angular orientation elements described. The tensioning device for the electrical cable 37 housed in the unit 47 or 47′ maintains the wires constantly taut. Even should an illumination unit 38 no longer be utilised, it can simply be separated from the structure 1 by the disconnection of the electrical plug 36. The replacement of the illumination units 38 with other types of units of different dimensions can take place simply without predetermined constraints on the dimensions. The advantages obtained with the illumination system of the present invention are apparent from what has been described. In particular, the displacement or the replacement of the various illumination units can be obtained without any necessity for dismantling of the supporting structure 1, nor any requirement to have to disconnect and reconnect the various electrical supply cables and services. Among other things, electrical sources of illumination of different type can be connected to the electrical connectors 15 of the interconnecting units 3, for example florescent lamps, incandescent lamps, quartz/iodine lamps, etc.; moreover, other sources of supplementary illumination can easily be connected to the electrical supply, and also other service devices such as, for example, loudspeakers or television cameras. These devices can be supported by the tubular elements 2 of the structure 1 in the same way as is illustrated for the support of the illumination units 38, that is to say by the support brackets 39. Moreover, the passage of the various electrical cables and service wiring through the tubular elements 2 provides a good aesthetic effect for the structure to be obtained. Likewise the inspection of the various electrical connections and branches, and even replacement of the cables or addition to the wirings, can be effected simply by separating the upper cover 28 from the main lower part 5 of the interconnection units 3.

Finally, it is clear that the embodiments of the present invention described can have various modifications and variations introduced thereto which do not depart from the scope of the invention itself. Among other things, the illumination unit 38 can be positioned on the tubular element 2 with rapid connection and disconnection elements, for example by means of screws 57 (FIG. 7) carried laterally of the portions 40. Or again, the interconnection units 3 could be supported from the ceiling by means of rigid bars rather than by means of the suspension wires 4.

What is claimed is:

1. An ambient illumination system, characterised by the fact that it comprises first means (1) constituting a fixed supporting structure for housing electrical supply cables (19), second means (3) supported in fixed position by said first means (1) and comprising at least an electrical connector (15) connected to said cables (19), and third means (38, 38′, 38″) supported by said first means (1) and displaceable along said first means and including electrical sources of illumination (44, 44′) supplied by said connectors (15) of said second means (3) and said first means is supported by connection elements (4, 55) to the ceiling and/or floor and said connection elements (4) are connected to said second means (3).

2. A system according to claim 1, characterised by the fact that the said structure (1) of the said first means is self supporting.

3. A system according to claim 1, characterised by the fact that it includes adjustment means (23, 25) between said second means (3) for adjusting the length of said ceiling support elements (4).

4. A system according to claim 1, characterised by the fact that said first means (1) include a pair of spaced tubular elements (2) disposed on the same plane and in at least one of which are housed said cables (19).

5. A system according to claim 4, characterised by the fact that the section of said tubular elements (2) is oval such as to present a greater rigidity to stresses perpendicular to the common plane in which the tubes lie.

6. A system according to claim 1, characterised by the fact that there are also housed service cables (18) in said first means (1).

7. A system according to claim 6, characterised by the fact that said second means (3) includes a box-like element (5) disposed between pairs of facing portions (2) of said first means (1), with integral positioning means (6) of said first means (2), with spaces (2) for the passage of said cables (19, 18) from said first means (2) to said box-like element (5) and an overall cover element (28).

8. A system according to claim 7, characterised by the fact that said box-like element (5) includes a plurality of said electrical connectors (15) and holes (17) through which the service cables (18) can pass to the outside.

9. A system according to claim 1, characterised by the fact that said third means (38, 38′, 38″) include rapid attachment and release elements (57) for connection to said first means (2).

10. A system according to claim 1, characterised by the fact that said third means (38, 38′, 38″) include support elements (39) on said first means (2) and between which they are interposed.

11. A system according to claim 1, characterised by the fact that said third means include electrical supply cables (37) for said source of illumination (44, 44′) connectable to said connectors (15) of said second means (3).

12. A system according to claim 1, characterised by the fact that said third means include angular orientation means (45, 48, 53) for the same electrical source of illumination (44, 44').

13. A system according to claim 1, characterised by the fact that it includes a plurality of said second (3) and/or third means (38, 38', 38'').

14. A system according to claim 1, characterised by the fact that said third means (38, 38', 38'') are replaceable with electrical sources of illumination of different dimensions on said first means (1).

15. A system according to claim 1, characterised by the fact that said third means include electrical sources of illumination of different types.

16. A system according to claim 1, characterised by the fact that said first means (1) also supports service devices which can be supplied from said electrical connectors (15) of said second means (3).

17. An ambient illumination system, characterized by the fact that it comprises first means (1) constituting a fixed supporting structure comprising first and second spaced tubular elements for housing electrical supply cables (19) and said elements each having a linear portion, second means (3) supported in fixed position by said first means (1) and comprising at least an electrical connector (15) connected to said cables (19), and third means (38, 38' and 38'') supported by said first means (1) and extending between said tubular elements' linear portions and displaceable along said first means and including electrical sources of illumination (44, 44') supplied by said connectors (15) of said second means (3) and said second means (3) are interposed between said tubular elements' linear portions of said first means (1).

18. A system according to claim 17, characterized by the fact that said first means is supported by connection elements (4, 55) to the ceiling and/or floor and said ceiling support elements (4) are connected to said second means (3).

19. A system according to claim 18, characterized by the fact that it includes adjustment means (23, 25) between said second means (3) for adjusting the length of said ceiling support elements (4).

20. A system according to claim 17, characterized by the fact that said third means includes angular orientation means (45, 48, 53) for the same electrical source of illumination (44, 44').

* * * * *